United States Patent [19]

Hasse

[11] 4,342,556

[45] Aug. 3, 1982

[54] APPARATUS FOR SIMULATED SHOOTING WITH HIT INDICATOR

[76] Inventor: Werner Hasse, Fischbeker Str. 18, 2153 Neu Wulmstorf, Fed. Rep. of Germany

[21] Appl. No.: 120,541

[22] Filed: Feb. 11, 1980

[30] Foreign Application Priority Data

Feb. 13, 1980 [DE] Fed. Rep. of Germany ..... 2905422

[51] Int. Cl.[3] ..... F41J 5/12

[52] U.S. Cl. ..... 434/22; 273/312; 434/21

[58] Field of Search ..... 434/21, 22, 16, 17, 434/19; 343/12 MD; 273/310, 311, 312, 371, 372

[56] References Cited

U.S. PATENT DOCUMENTS 4,019,262 4/1977 Breglia et al. ..... 434/21
4,212,412 7/1980 Ikeda ..... 273/310

FOREIGN PATENT DOCUMENTS 1261019 2/1968 Fed. Rep. of Germany .
1953793 4/1971 Fed. Rep. of Germany ..... 273/371
2149729 4/1973 Fed. Rep. of Germany .

*Primary Examiner*—Vance Y. Hum
*Assistant Examiner*—Leo P. Picard
*Attorney, Agent, or Firm*—Arnold, White & Durkee

[57] ABSTRACT

An apparatus for simulated shooting is disclosed which includes a laser transmitter for directing a laser beam, as a simulated shot, towards a target; a receiver and evaluation device on the target for determining the deviation of the laser beam from the target in terms of magnitude and direction, and an impact indicating device on the target which is controllable by the evaluation device such that pyrotechnic charges are ejected in the determined direction of the deviation of the laser beam from the target and ignited so as to represent the light and smoke phenomena of the impact of a real projectile.

14 Claims, 4 Drawing Figures

APPARATUS FOR SIMULATED SHOOTING WITH HIT INDICATOR

BACKGROUND OF THE INVENTION

1. Field of the Invention

The invention relates to an apparatus for simulating the firing of a weapon and the explosion of the ammunition projectile for shots which are both on and off target.

2. Description of the Prior Art

Generally, the object of an apparatus for simulated shooting must be a simulation and representation of the conditions which occur during actual shooting which are as true to reality as possible. As shown in German Pat. No. 1,261,019, a basic shooting simulator consists of a laser emitter coupled to a weapon, and one or more receivers which are located at the target. Whenever the receivers are struck by the emitted laser beam, a hit indicator is triggered which, for the purpose of a realistic response, sets off a pyrotechnic charge which imitates the light and/or smoke phenomena of the impact of a projectile. In place of the receiver at the target area, it is also possible to provide a reflector at the target and a receiver for the reflected laser radiation at the location of the emitter. In this case there must be an additional repeat signal, for example via radio, to the target in order to trigger the representation or simulation of the hit.

In the further development of shooting simulators, it was desired not only to be able to distinguish between hits and misses, but also to obtain qualitative information about the deviation of the simulated shot from the target, that is, the deviation of the hit point from the intended target. For this purpose, it is known to cause the laser beam to pass in a scanning pattern (German Laid-Open Application DAS No. 1,703,109) or to transmit numerous laser beams, marked by different pulse coding, in such a way that the individual laser beam segments are contiguous, without gaps or overlapping, so as to fill up a relatively large solid angle sector in the manner of a matrix (German Laid-Open Application DOS No. 2,149,729). An evaluation device is connected to the receiver located in the target area or at the emitter area, which device detects the point of the scanning pattern or of the solid angle matrix where the laser beam strikes the target, and from this determines the deviation of the sighted, simulated shot from the target in terms of magnitude and direction.

To determine the hit accuracy in a manner which is even more true to reality, the evaluation device can include consideration of further parameters, such as, for example, the measured target distance, the type of ammunition, the resulting transit time of the projectile, the angle of lead and the like in its evaluation. The result provides information as to whether and by how much the gunner has shot to the right or to the left, high or low, or too short or too far.

However, prior hereto, these refined measurement and evaluation methods for the hit accuracy in simulated shooting have not been utilized or translated in a manner sufficiently true to reality to represent or reflect the calculated deviations. This is to say that nothing had been developed which approached or simulated the actual explosion of "misdirected" shots and the visual feedback thus provided to a gunner. The amount and direction of the deviation of the hit point from the target can, for example, be indicated numerically. This may be valuable to the shooting instructor for assessing the gunner, but it is not of much use to the gunner himself since he must keep the target in view, and cannot read off any numerical indications, much less recalculate them into corrected aiming values.

Proposals have been made for the arrangement of light-emitting diodes on the edge of the field of vision of the weapon sight, which diodes are triggered selectively in order to indicate to the gunner whether his shot has gone to the right, to the left, high or low. A similar proposal envisages that a matrix of light-emitting diodes is reflected into the sight, which diodes can be triggered selectively for generating in the sight a point of light in a position which corresponds to the measured deviation from the observed target or aiming point.

All these electro-optical indications are of dubious value for the gunner because, in order for him to observe the indication, he must readapt his visual focal point from a distant target, which may virtually be to infinity, to a close object, namely the electro-optical indication. This is a complication and a nuisance, and would be of particular difficulty, for example, in the semi-darkness of an armored vehicle, or in bad weather and the like. The gunner requires several seconds for realigning or readjusting his eye to the target and, if the target has moved in the meantime, he must first visually locate the target again before he can fire a second, corrected shot of laser light. Furthermore, a light-emitting diode cannot imitate the light and smoke phenomena of the impact of a hit which occur in real sharpshooting. Such electro-optical indications are thus unrealistic and are not typical for a weapon system or for combat.

The known indicator devices are also subject to the disadvantage that they are or can be observed only by those in a position to read the devices, for example the gunner, and perhaps also the shooting instructor. They cannot be observed by the other participants of the shooting exercise or the maneuver. This is a disadvantage and a detraction from the realism of an exercise because, with simulated shots which merely go into the vicinity of the target and do not terminate with some kind of visual event, the persons at the target or in the target area do not know in which direction they must seek cover or initiate counter measures.

Accordingly, prior to the development of the present invention, there has been no apparatus for simulated shooting which makes it possible to obtain a representation, in a manner as true to reality as possible, of shots which merely land in the vicinity of the target; or of a representation which takes into account the measured and evaluated deviation of the hit from the target; or of a representation of the explosion of real projectiles in a manner which allows the gunner to make sight corrections on that basis as he would in a realistic situation; or finally, which can readily be observed by as many participants of the shooting exercise as possible. Therefore, the art has sought shooting simulation apparatus which can realistically represent actual shooting for all participants in the exercise.

SUMMARY OF THE INVENTION

According to the invention, the foregoing benefits are achieved in the present simulated shooting apparatus. The apparatus for simulated shooting of the present invention includes a laser transmitter for directing a laser beam at a target, and an evaluation means at the target which can determine the direction of deviation of the laser beam from the target. A hit indication means consisting of a pyrotechnic charge and a means to ignite that charge is arranged on the target, and pursuant to an ejection means controlled by the evaluation means, the pyrotechnic charge is ejected in a direction corresponding to the direction of deviation of the laser beam as determined by the evaluating means.

Thus, the idea for solving the problem, on which the invention is based, consists in not only indicating direct hits by means of pyrotechnic charges fitted immediately to the target, but also imitating simulated impacts of projectiles which merely land in the vicinity of the target, by pyrotechnic charges which are ejected from the target in the particular direction corresponding to the deviation of the laser beam from the target and which are ignited at the correct distance from the target.

Within the scope of the invention, there are numerous different possibilities for the constructional design of the ejector means or device and for the manner of triggering the latter by the evaluation device of the shooting simulator.

A feature of the present invention is that the ejector device can be controlled both as a function of the measured deviation of the shot from the target and as a function of other parameters, such as, the measured target distance, the type of ammunition and the like, so that projectile impacts can be simulated not only to the right or left of the target, but also in front of or beind the target, by the ejection of pyrotechnic charges in the corresponding directions. Moreover, not only the direction, but also the range of the ejection of the pyrotechnic charges or the distance of the target from the point where the ejected pyrotechnic charge is brought to ignition may be controlled by the evaluation device.

According to a preferred embodiment of the invention, the target is equipped with an evaluation means including an all-round (that is, omnidirectional) receiver for laser radiation, which receiver contains means for determining the direction of incidence of the laser radiation. In addition to the parameters already indicated, such as deviation of the hit, target distance and the like, the evaluation device can also detect the direction of firing and likewise take this information into account when adjusting the direction of ejection of the pyrotechnic charges.

Another feature of the present invention is that the ejection of the pyrotechnic charges can be effected in various ways, for example, by mechanical means such as springs or the like, or by compressed air, or by propellant charges associated with the individual pyrotechnic charges.

There are also various possibilities for adjusting or selecting the direction of ejection of the pyrotechnic charge so that it corresponds to the deviation of the shot (laser beam) from the target, as determined by the evaluation means. It should be recognized that it is not necessary to adjust the direction or ejection with fine accuracy, but that, as a rule, it will suffice to eject the pyrotechnic charges in the approximate direction corresponding to the calculated deviation of the shot. An ejector device can be provided which has a plurality of ejection guides which are oriented in varying fixed directions and which are each loaded with pyrotechnic charges. These individually loaded ejection guides may then be selectively triggered by the evaluation device. For example, pyrotechnic charges may be selectively ejected vertically upwards, upwards under 45°, horizontally to the side, or to the front or the like. If a more exact adjustment of the direction of ejection is desired or required, it is possible to provide ejection guides which can be adjusted for elevation and traverse, such adjustments being controlled and triggered by the evaluation device.

In another feature of this invention, one or more obliquely upward-pointing ejection guides may be used which revolve continuously about a vertical axis and which are triggered by the evaluation device at the moment the instantaneous angle of rotation corresponds to the direction of the deviation of the shot, as determined. As a rule, restrictions with respect to the accuracy of the direction of ejection will be acceptable for the sake of the simplest, cheapest and most robust possible design of the ejector device.

In yet another feature of the invention, the ejector device may be fitted with exchangeable carriers which can be discarded after use. Each carrier would receive a multiplicity of ejectable pyrotechnic charges, for example in a matrix-like arrangement, and would be provided with the requisite feed lines for the ignition devices and ejector devices.

In order to be able to control the distance from the target at which the explosion of the pyrotechnic charge occurs, each pyrotechnic charge can be provided with a time fuse of a fixed delay time, and the evaluation device can independently control the point in time of triggering the time fuse in such a way that the ignition of the pyrotechnic charge takes place exactly at the end of the assumed distance-dependent transit time of the projectile, and the point in time of ejecting the pyrotechnic charge in such a way that the ignition takes place at the correct distance from the target object, corresponding to the calculated deviation of the fired shot (laser beam).

The shot simulated apparatus of the present invention, when compared with the previously discussed prior art, has the advantages of an actual shooting exercise wherein the impacts and explosions of missed shots, as well as hits, may be observed by all participants and may be utilized by the gunners for sight corrections for subsequent shots.

BRIEF DESCRIPTION OF THE DRAWINGS

Embodiments of the invention are explained in more detail by reference to the drawings in which.

While the invention will be described in connection with particular embodiments, it will be understood that it is not intended to limit the invention to those embodiments. On the contrary, it is intended to cover all alternatives, modifications and equivalents as may be included with the spirit and scope of the invention as defined by the appended claims.

DETAILED DESCRIPTION OF THE INVENTION

Figure 1:
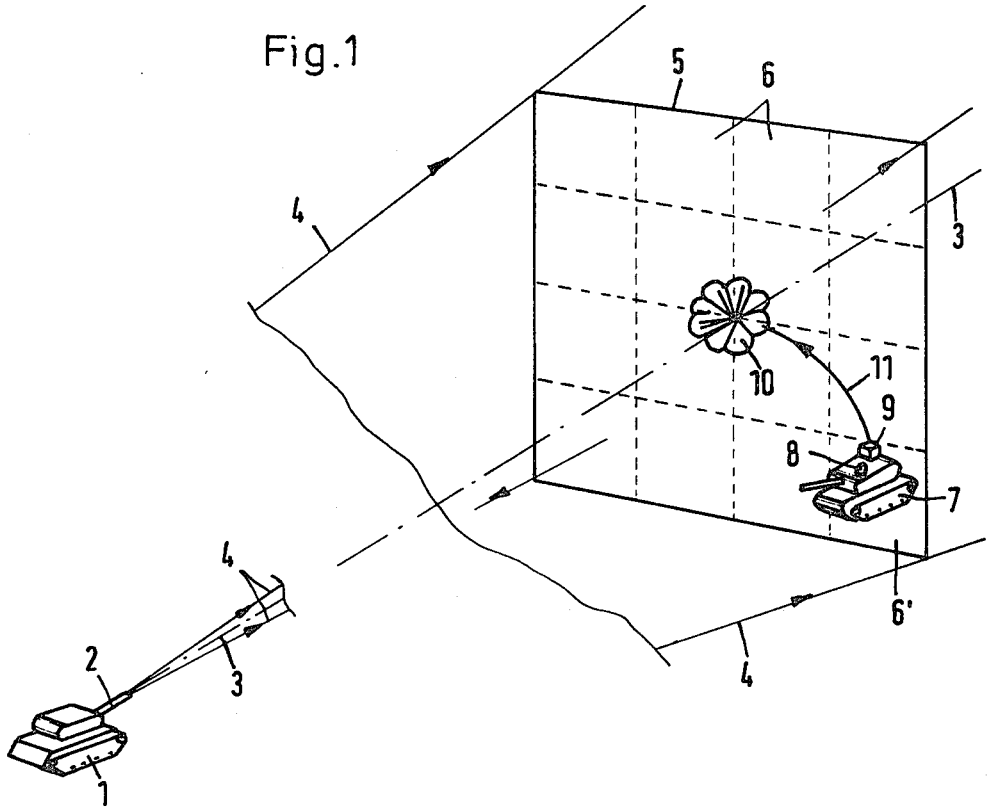
FIG. 1 is a perspective diagrammatic representation illustrating the mode of functioning of the apparatus of the present invention by reference to two combat vehicles engaged in a simulated shooting battle.

FIG. 1 shows a first combat vehicle 1 having a laser transmitter which is coupled to its weapon 2 and by means of which it transmits a pulsed laser pencil beam 4 along a target line 3, when a shot is to be simulated. The laser pencil beam 4 is composed of a number of smaller laser pencil beams which are emitted simultaneously or in a time sequence and which are mutually adjacent, without gaps or overlap, in such a way that they fill up the solid angle sector of the laser pencil beam 4 in the manner of a matrix. The individual smaller laser pencil beams can be marked by different pulse codings and/or by their time sequence. Corresponding to the divergence (drawn in FIG. 1 on an exaggerated scale), the composite laser pencil beam 4 has a cross-section 5 which continuously increases with increasing distance from the transmitting vehicle 1 and which is subdivided in the manner of a matrix into individual sectors 6, each sector being associated with a different pulse coding or time sequence of the laser radiation.

The transmission of the laser radiation simulates a shot which is intended to be aimed at a target vehicle 7 which is fitted with an evaluation means including a receiver 8 for the laser radiation. If the weapon 2 is aimed inaccurately, the target line 3, that is to say the central axis of the laser pencil beam 4, will run at some distance from the target vehicle 7 so that the receiver 8 is struck by the laser radiation of a sector 6', which is relatively far away from the central axis 3 of the matrix 5. The receiver 8 is connected to an evaluation device which, from the pulse coding and/or time sequence of the laser radiation associated with the sector 6', identifies this sector 6' and calculates the deviation of the target vehicle 7 from the target line 3 in the vertical and lateral direction.

The apparatus described above for simulated shooting and for determining the deviation of the simulated shot from the target are known. Within the scope of this invention, these elements can be replaced by other types of apparatus, for example, a sharply focussed laser beam which passes through a scanning pattern, or the like might be used. Instead of the receiver 8 in the target area, it is also possible to provide a retro-reflector on the target vehicle 7 which reflects the laser radiation back to the transmitter vehicle 1 to a receiver with an evaluation device connected thereto. The evaluation result can then be transmitted to the target vehicle 7 by suitable means, such as by radio signal or by a repeated laser beam emission.

According to the invention, the target vehicle 7 also comprises an ejector device 9, by means of which pyrotechnic charges can be ejected in various directions. The ejector device 9 is controlled by the evaluation device, which is connected to the receiver 8, in such a way that a pyrotechnic charge is ejected in the direction of the vertical and lateral deviation of the target vehicle 7 from the target line 3, as determined by the evaluation device. This pyrotechnic charge may be ignited after ejection by means of a suitable time fuse in such a way that it will explode approximately on the target line 3 and will represent a projectile impact or a projectile explosion by flash and/or smoke evolution 10. In the example shown in FIG. 1, the gunner in the vehicle 1 has held the target line 3 too far above and to the left of the target vehicle 7. Accordingly, the pyrotechnic charge is ejected on a trajectory 11 pointing upwards to the left. Of course, other shooting errors can also be taken into account. For example, it is possible to determine from additional transmitted data whether the simulated shot is short or long, and a pyrotechnic charge can be ejected accordingly from the target vehicle 7 forward in the direction of the vehicle 1 or, in the case of an overshot, vertically upwards or obliquely rearwards.

The flash and/or smoke phenomena 10 of the pyrotechnic charge at the distance corresponding to the deviation of the shot from the target vehicle 7 can be observed in the sight by the gunner in the vehicle 1 and can be used for correcting the shot. It can also be observed by all the other participants in the shooting exercise, including the occupants of the target vehicle 7. Of course, the target vehicle 7 can likewise be provided with a laser transmitter and the shooting vehicle 1 can likewise be provided with a receiver and an ejector device for pyrotechnic charges, said ejector device controlled by an evaluation means. Moreover, the vehicles 7 or 1 can also be provided with pyrotechnic charges which are not ejected but which are caused to ignite on the vehicle itself if the light and/or smoke phenomena of a direction hit or of the firing of the weapon are to be represented. Furthermore, devices for generating a bang or appropriate audio representation can also be provided.

Figure 2:
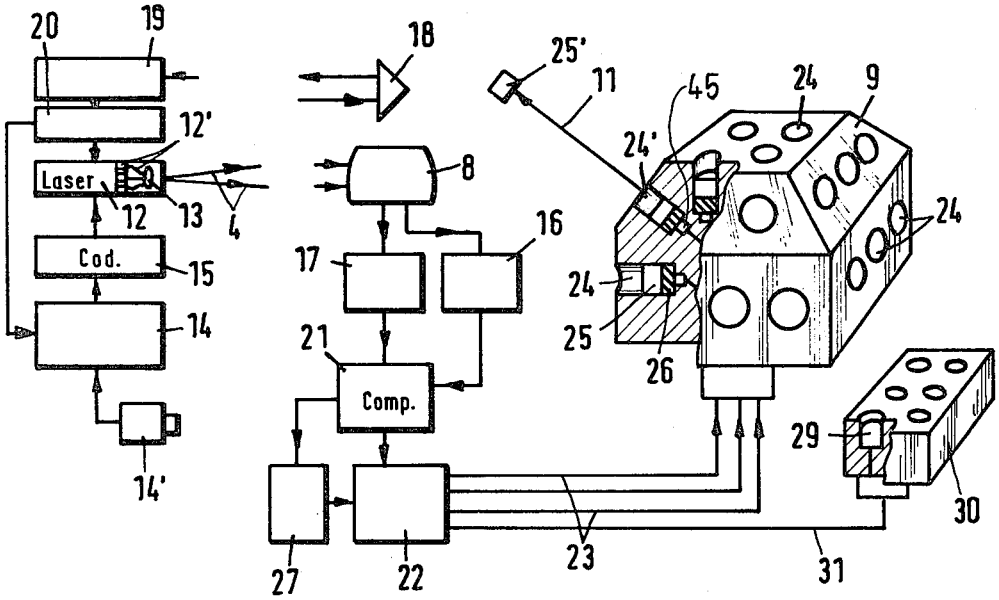
FIG. 2 shows a block diagram of the apparatus for simulated shooting according to an embodiment of the invention, with an ejector device which is shown perspectively and partially cut away.

In FIG. 2, the individual elements of the apparatus according to the invention are shown diagrammatically. On the transmitter side, that is to say on the vehicle 1, there is the laser transmitter 12 which generates the composite laser pencil beam 4, possibly by means of a number of semiconductor laser diodes 12' which are coupled via fiberoptic conductors to an optical system 13. The control of the laser transmitter 12 is effected via a control instrument which can be actuated by the firing key 14 of the weapon and which can also receive the input of, or store, other shooting data, such as information about the ammunition, or the armoring of the target vehicle and the like, and which controls the laser transmitter 12 via a coding stage 15 in order to generate the suitable pulse coding of the individual laser pencil beams.

On the receiver side, that is to say on the target vehicle 7, there is the receiver 8 which is preferably designed as an omnidirectional, that is to say all-round, receiver with means for determining the direction of incidence of the radiation. All-round receivers of this type are in themselves known (compare, for example, German Laid-Open Application DAS No. 2,533,214). A computer stage 16 is connected to the receiver 8 for determining the direction of incidence of the laser radiation. Also connected to the receiver 8 is a decoder stage 17 for decoding the information which is contained in the pulse coding of the laser radiation and which inter alia provides data about the location of the receiver 8 in the sectors 6, 6' of the matrix 5 (FIG. 1). The pulse coding also contains further information, such as about the distance between the transmitter vehicle 1 and the target vehicle 7. This shooting distance can be determined as follows: at the place of the receiver 8, a retro-reflector 18 is provided which is likewise struck by the laser pencil beam 4 and reflects the laser radiation back to the vehicle 1, where it is received by a receiver 19; from the transmit time, the distance is measured in the range finder 20, and a second laser pulse emitted by the laser transmitter 12 is then modulated with this distance as information.

From the information obtained in the directional evaluation device 16 and the decoder stage 17, a computer stage 21 calculates the amount of deviation of the simulated shot from the target vehicle 7, in terms of magnitude and direction. This evaluation result is fed to a control stage 22 which is connected via lines 23 to the ejector device 9. In the embodiment shown in FIG. 2, the ejector device consists of a polygonal body having surfaces which point in various directions and in which is a multiplicity of open bores 24 which each form a firing or ejection guide for a pyrotechnic charge.

An ejectable pyrotechnic charge 25 is inserted into each of the bores 24. Between this charge and the bottom of the bore 24, a propellant charge 26 is arranged which can be ignited by an electric fuse 45 at the bottom of the bore 24, which fuse is connected via an ignition line to the lines 23 and can thus be triggered selectively by the control instrument 22. Depending on the result of the evaluation of the position of the hit relative to the target, carried out in the computer stage 21, one (for example 24') of the firing guides 24 of the ejector device 9, the orientation of which firing guide approximately corresponds to the determined direction of the deviation of the hit (that is to say which points to the upper left in the illustrative embodiment), is triggered via the control instrument 22. As a result of the ignition of the propellant charge, the pyrotechnic charge 25' is ejected on a corresponding trajectory 11, and it can include a time fuse which is ignitable by the ignited propellant charge, so that it is ignited at a distance from the ejector device 9 and generates the desired flash and/or smoke phenomena. The point in time of the ignition of the propellant charge 26 and hence of the ejection of the pyrotechnic charge can be controlled by the computer stage 21 via a time delay stage 27 in such a way that the point in time of igniting the ejected pyrotechnic charge 25' exactly corresponds to the end of the (simulated) transit time of the projectile, which transit time in turn depends on the result of the range measurement and on the assumed type of ammunition.

In a further refinement of the apparatus, it is also possible to ignite the time fuse of the pyrotechnic charge 25' at an earlier point in time than the propellant charge 26 and independently of the latter, in such a way that the pyrotechnic charge 25' is ignited at a point in time which corresponds to the end of the transit time of the projectile, and at a distance from the ejector device 9 which corresponds to the measured deviation of the hit.

In addition to the ejectable pyrotechnic charges 25, it is also possible to provide non-ejectable pyrotechnic charges 29, combined on a separate carrier 30 on the target vehicle 7. The pyrotechnic charges 29 can likewise be triggered by the control instrument 22 via one or more lines 31 whenever a direct hit on the target vehicle 7 itself is to be represented and/or when simulated firing with the weapon of the vehicle 7 is to be made optically visible by flash, smoke and/or bang phenomena. Corresponding to their varying tasks, the pyrotechnic charges 25 and 29 can be of different make-up and can thus provide differing flash, smoke and/or bang effects.

The representation, according to this invention, of the position of a hit relative to a target by means of ejectable pyrotechnic charges can also be combined with other known methods of representing the position of a hit. For example, it may be combined with an electro-optical representation by means of light-emitting diodes which are visible in the sight of the weapon 2 of the vehicle 1, or the like.

Figure 3:
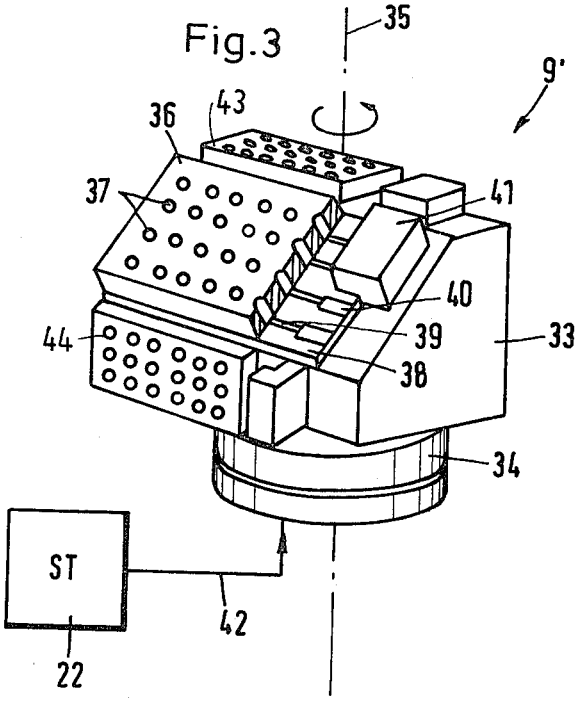

In the embodiment according to FIG. 3, a desk-like carrier 33 is provided which, by means of a bearing 34, is mounted to be rotatable about a vertical axis 35 and is kept continuously rotating by a motor (not shown). A matrix plate 36 is exchangeably fitted on carrier 33, which plate has numerous bores 37 designed to receive pyrotechnic charges with associated propellant charges. The matrix plate 36 is also joined to a base plate 38 on which feed tracks run as printed circuits to the fuses of the propellant charges and pyrotechnic charges in the bores 37. One edge of the base plate 38 is formed as a patchboard strip which can be brought into engagement with a socket console 40, whereby the connections to the feed lines 39 are made. The socket console 40 is connected by line 41 to the control instrument 22, by means of which the individual pyrotechnic charges and their propellant charges in the bores 37 can be ignited at the time during the rotation of the desk-like carrier 33 that the instantaneous angular position of the carrier corresponds to the direction of the hit deviation determined by the shooting simulation apparatus. In this way, all the hit deviations which are located in any direction to the side of and above the target can be simulated. In order to be able to represent hit deviations vertically above the target or horizontally to the side of the target or in front of the target, similar matrix plates 43, 44, with pyrotechnic charges, can also be fitted to the horizontal upper face and to the vertical front face of the carrier 33. These charges are ignited in the same manner as the charges of matrix plate 36.

Figure 4:
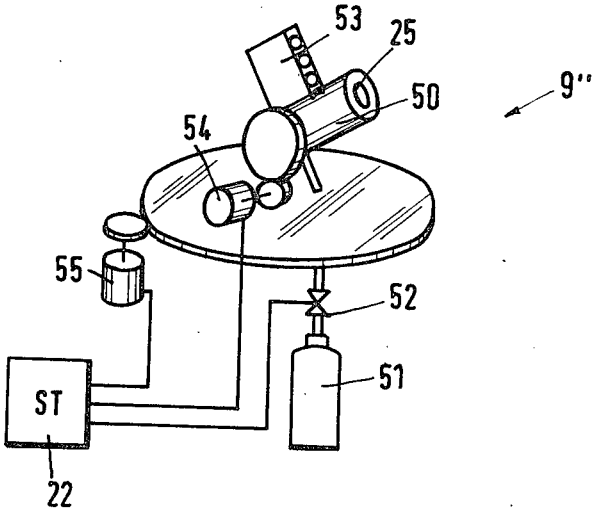
FIGS. 3 and 4 show alternative embodiments of the ejector device.

In the embodiment according to FIG. 4, an ejector device 50 is provided which is constructed in the manner of an air gun, and which can be supplied with compressed air from a compressed air cylinder 51 via a controllable valve 52, in order to eject a pyrotechnic charge 25. After firing, the device can be recharged from a magazine 53. The ejector device 50 can be adjusted for elevation about a horizontal axis by means of a drive 54 adjusting the elevation, and it can be adjusted for traverse about the vertical axis by means of the drive 55 adjusting the traverse. The adjustment drives 54, 55 and the compressed air valve 52 are controllable by the control instrument 22, corresponding to the hit deviation determined by the shooting simulator, and to the desired point in time for triggering.

The foregoing description of the invention has been directed to particular embodiments including a preferred embodiment in accordance with the requirements of the Patent Statutes and for purposes of explanation and illustration. It will be apparent, however, to those skilled in this art that many modifications and changes in this apparatus may be made without departing from the scope and spirit of the invention. For example, ejection of the pyrotechnic charge could be effected by means of flexed rubber strips, or the like, and different ejection modules could be utilized to increase the number of trajectories which could be simulated.

It is the applicant's intention in the following claims to cover such modifications and variations as fall within the true spirit and scope of the invention.

What is claimed is:

1. An apparatus for simulating shooting, comprising:

a laser transmitter for transmitting a laser beam towards a target;

evaluation means for determining the direction of deviation of the laser beam from the target;

a hit indication means positioned on the target comprising at least one pyrotechnic charge; and ignition means to ignite the pyrotechnic charge in response to the evaluation means;

an ejector device controlled by the evaluation means for ejecting the pyrotechnic charge from the target; and ejector directional means in the ejector device for modifying the direction of ejection of said pyrotechnic charge;

said ejector directional means being controllable by said evaluation means so that the direction of ejection of the pyrotechnic charge is substantially into the direction corresponding to the off-aim direction determined by the evaluation means.

2. The apparatus of claim 1 wherein the evaluation means determines the direction and magnitude of the deviation of the laser beam from the target; and the ejector device is controllable in response to the magnitude of deviation of the laser beam from the target to achieve a corresponding ejecting distance of the pyrotechnic charge.

3. The apparatus of claim 1, wherein the time interval between the ejection and the ignition of the pyrotechnic charge is controllable by the evaluation means.

4. The apparatus of claim 1 wherein the ejection of the pyrotechnic charge is effected by means of propellant charges.

5. The apparatus of claim 1, wherein the ejection of the pyrotechnic charge is effected by means of compressed air.

6. The apparatus of claim 1, wherein the ejection of the pyrotechnic charge is effected by means of a spring.

7. The apparatus of claim 1, where the ejector directional means comprises at least one ejection guide which is adjustable about the vertical and horizontal axes pursuant to signals from the evaluation means.

8. The apparatus of claim 1, wherein the ejector directional means comprises a plurality of ejection guides which are in fixed orientations in various directions and which ejection guides can be selectively triggered by the evaluation means.

9. The apparatus of claim 1, wherein the ejector directional means comprises:

a carrier, said carrier mounted for continuous rotation about a vertical axis; and a plurality of ejection guides for pyrotechnic charges arranged in said carrier;

said pyrotechnic charges being individually ejectable pursuant to control signals from the evaluation means at a point in time corresponding to the desired rotational position of the carrier.

10. The apparatus of claim 9, wherein the ejection guides are arranged in the carrier at a fixed angle of elevation relative to the horizontal plane.

11. The apparatus of claim 1, wherein the pyrotechnic charges can be individually recharged into the ejection device.

12. The apparatus of claim 1, wherein the ejector device includes a plate wherein the pyrotechnic charges are arranged in the manner of a matrix, said plate being exchangeably fixed to the ejector device.

13. The apparatus of claim 1, wherein the ejector device further includes ignition devices controllable by the evaluation means for igniting time fuses on the pyrotechnic charges.

14. The apparatus of claim 13, wherein the ignition of the time fuses of the pyrotechnic charges is generated by the evaluation means as a function of the measured deviation of the laser beam before the evaluation means effects the ejection of the pyrotechnic charges.

* * * * *